US006463612B1

(12) United States Patent
Potter

(10) Patent No.: US 6,463,612 B1
(45) Date of Patent: Oct. 15, 2002

(54) BLADDER AND METHOD OF MAKING THE SAME

(75) Inventor: Daniel R. Potter, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 72 days.

(21) Appl. No.: 09/722,285

(22) Filed: Nov. 28, 2000

Related U.S. Application Data

(62) Division of application No. 09/186,183, filed on Nov. 5, 1998, now Pat. No. 6,258,421, which is a division of application No. 08/095,476, filed on Jul. 23, 1993, now Pat. No. 5,832,630.

(51) Int. Cl.[7] ..... A43D 9/00; A43D 11/00; A43D 21/00; A43B 13/20; A43B 7/14

(52) U.S. Cl. ..... 12/146 B; 12/146 M; 36/29; 36/43; 36/153

(58) Field of Search ..... 36/28, 29, 35 B, 36/43, 44, 88, 93, 71, 153, 31; 12/146 B, 146 M

(56) References Cited

U.S. PATENT DOCUMENTS

| | | | | |
|---|---|---|---|---|
| 900,867 A | | 10/1908 | Miller | |
| 1,069,001 A | | 7/1913 | Guy | |
| 1,304,915 A | | 5/1919 | Spinney | |
| 1,514,468 A | | 11/1924 | Schopf | |
| 1,625,582 A | | 4/1927 | Anderson | |
| 1,869,257 A | | 7/1932 | Hitzler | |
| 2,080,469 A | | 5/1937 | Gilbert | |
| 2,488,382 A | | 11/1949 | Davis | |
| 2,645,865 A | | 7/1953 | Town | |
| 2,677,906 A | | 5/1954 | Reed | |
| 2,715,231 A | | 8/1955 | Marston | |
| 3,030,640 A | | 4/1962 | Gosman | |
| 3,589,037 A | | 6/1971 | Gallagher | |
| 3,758,964 A | | 9/1973 | Nishimura | |
| 3,765,422 A | | 10/1973 | Smith | |
| 3,795,994 A | * | 3/1974 | Ava | 36/29 |
| 3,922,801 A | * | 12/1975 | Zente | 36/44 |
| 4,017,931 A | | 4/1977 | Golden | |
| 4,049,854 A | | 9/1977 | Casey et al. | |
| 4,115,934 A | | 9/1978 | Hall | |
| 4,129,951 A | | 12/1978 | Petrosky | |
| 4,183,156 A | | 1/1980 | Rudy | |
| 4,217,705 A | | 8/1980 | Donzis | |
| 4,219,945 A | | 9/1980 | Rudy | |
| 4,287,250 A | | 9/1981 | Rudy | |
| 4,297,797 A | | 11/1981 | Meyers | |
| 4,305,212 A | | 12/1981 | Coomer | |
| 4,445,283 A | | 5/1984 | Meyers | |
| 4,446,634 A | | 5/1984 | Johnson et al. | |

(List continued on next page.)

FOREIGN PATENT DOCUMENTS

| | | | | |
|---|---|---|---|---|
| GB | 2 050 145 | | 1/1981 | |
| GB | 2050145 A | * | 1/1981 | A43B/13/20 |
| TW | 123336 | | 11/1989 | |
| TW | 134162 | | 5/1990 | |
| TW | 160500 | | 6/1991 | |
| TW | 173484 | | 11/1991 | |
| WO | WO 89/10074 | | 11/1989 | |

*Primary Examiner*—Anthony D. Stashick
(74) *Attorney, Agent, or Firm*—Banner & Witcoff, Ltd.

(57) ABSTRACT

A bladder usable in the sole of a shoe for supporting the plantar area includes a plurality of chambers designed to provide a resilient resistance force. In the fabrication of the bladder, each of the chambers is formed in fluid communication with each other, and fluid is supplied into the chambers at a selected location. After the chambers have been pressurized to the desired internal pressure, the fluid communication port(s) is sealed. Although certain of the chambers are pressurized to the same internal pressure, different resistance forces are provided by forming the chambers with different volumes.

23 Claims, 8 Drawing Sheets

U.S. PATENT DOCUMENTS 4,670,995 A 6/1987 Huang
4,722,131 A 2/1988 Huang
4,912,861 A 4/1990 Huang
4,936,029 A * 6/1990 Rudy ..... 36/153
4,991,317 A 2/1991 Lakic
4,999,931 A 3/1991 Vermeulen
5,025,575 A 6/1991 Lakic
5,179,792 A 1/1993 Brantigham
5,832,630 A 11/1998 Potter

* cited by examiner

BLADDER AND METHOD OF MAKING THE SAME

CROSS REFERENCE TO RELATED APPLICATIONS

This application is a divisional application of application Ser. No. 09/186,183 filed Nov. 5, 1998, now U.S. Pat. No. 6,258,421 which is a divisional of application Ser. No. 08/095,476 filed Jul. 23, 1993, now U.S. Pat. No. 5,832,630.

BACKGROUND OF THE INVENTION

The present invention pertains to a bladder, having particular usefulness in the sole of a shoe, and a method for making the same.

Bladders have long been used in shoes as a cushion to increase shoe comfort, enhance foot support, reduce the risk of injury and other deleterious effects, and decrease fatigue. In general, the bladders are comprised of elastomeric materials which are shaped to define at least one pressurized pocket or chamber. Typically, a bladder will actually define many chambers arranged in a pattern designed to achieve one or more of the above-stated objectives. The chambers may be pressurized with a number of different mediums, such as air, various gases, water, or other liquids.

Many different chamber configurations have been developed in an effort to achieve the desired results. For instance, bladders have been constructed with a single chamber that extends over the entire area of the sole. One example of this type of bladder is disclosed in U.S. Pat. No. 2,080,469 to Gilbert, entitled "Pneumatic Foot Support." Alternatively, bladders have included a number of chambers fluidly interconnected with one another. Examples of these types of bladders are disclosed in U.S. Pat. No. 4,183,156 to Rudy, entitled "Insole Construction For Articles of Footwear," and U.S. Pat. No. 900,867 to Miller, entitled "Cushion for Footwear." However, these type of bladder constructions have been known to flatten and "bottom out" when they receive high impact pressures, such as experienced in athletic activities. Such failures negate the intended benefits of providing the bladder.

In an effort to overcome this problem, bladders have been developed wherein the chambers are fluidly connected by restricted approaches, however, have not been entirely successful. With respect to the restricted flow bladders. the results have had only limited success in actually providing the desired differences in pressure. Although the independent bladders effectively provide different pressures at various points across the sole, the cost to manufacture the bladders has been prohibitively high. As illustrated in FIGS. 3 and 7 in the '906 patent to Reed, each independent chamber must be individually pressurized. As can be readily appreciated, this process is not suitable for mass production, particularly in bladders having a significant number of chambers.

SUMMARY OF THE INVENTION

The aforementioned problems are overcome in the present invention, wherein a bladder having a unique independent chamber construction can be manufactured without the heretofore high attendant costs.

More specifically, a bladder in accordance with the present invention is particularly useful in the sole of a shoe. The bladder includes a plurality of chambers which are strategically arranged under specific areas of the plantar surface. The chambers are pressurized to a certain internal pressure. Nevertheless, because the chambers define differing volumes of pressurized fluid, each of the chambers are capable of providing a unique resistance. This capacity enables the bladders to provide the desired support and cushion to any particular portion of the foot. Thus, the bladder may be specially adapted to accommodate a particular activity.

In addition, by practicing the method of the present invention, a bladder with these characteristics, can be fabricated quickly, easily, and at a low cost. The method involves selectively forming a number of chambers with an elastomeric material, such that each chamber is in fluid communication with the others. Thereafter, the interior of the product is supplied with an amount of fluid, so that the chambers are all pressurized at the same desired level. The fluid communication is then sealed so that each of the chambers is separated from the other chambers.

As another aspect of the invention, certain portions of the bladder can be pressurized to different levels. In this process, a first set of chambers are formed in fluid communication with each other; and a separate second set of chambers are formed in fluid communication with each other. The first set is not in fluid communication with the second set. These two discrete portions are then each supplied with a quantity of fluid so that each set of chambers is pressurized at a different level. Thereafter, the fluid communications are sealed so that each chamber is separated from the other chambers.

As can be readily appreciated, the practice of either aspect of the inventive process facilitates the manufacture of a bladder having the above-described desirable characteristics in a manner which eliminates the difficulties experienced in the past. Specifically, a bladder having independent chambers that each provide a unique resistance, can be made without having to individually pressurize each chamber. Further, the process is quick, easy, and economical.

These and other objects, advantages, and features of the present invention will be more fully understood and appreciated by reference to the specification and appended drawings.

DETAILED DESCRIPTION OF THE PREFERRED EMBODIMENT

Figure 4:
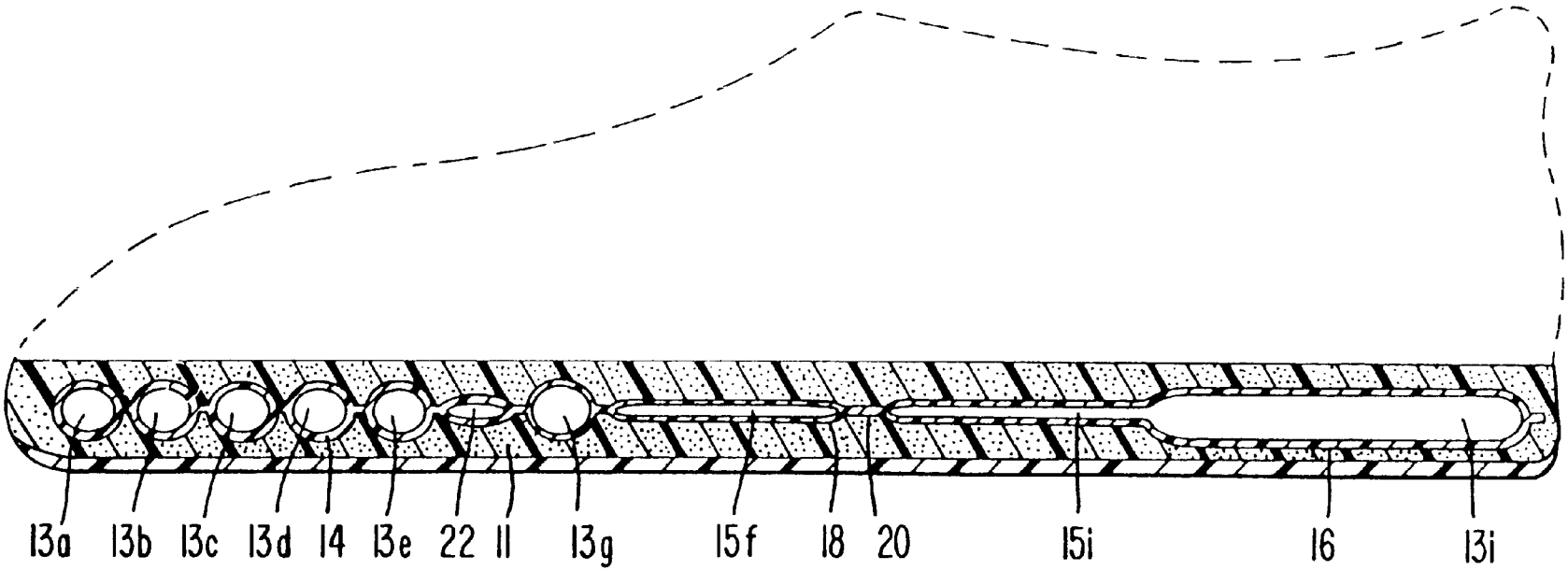
FIG. 4 is a cross-sectional view of the bladder shown in FIG. 1*a* contained within a midsole of a shoe.

In a preferred embodiment of the invention (FIGS. 1 and 1*a*), a bladder 10 is a thin, elastomeric member defining a plurality of chambers or pockets 12. The chambers are pressurized to provide a resilient support. Bladder 10 is particularly adapted for use in the midsole of the shoe, but could be included in other parts of the sole or have applicability in other fields of endeavor. In a midsole, bladder 10 would preferably be encapsulated in an elastomeric foam 11 (FIG. 4). As is well known in the art, the foam need not fully encapsulate the bladder. Moreover, the bladder can be used to form the entire midsole or sole member.

Preferably, bladder 10 is composed of a resilient, plastic material such as a cast or extruded ester base polyurethane film having a shore "A" hardness of 80 to 95 (e.g., Tetra Plastics TPW-250) which is inflated with hexafluorethane (e.g., Dupont F-116) or sulfur hexafluoride. However, other materials and fluids having the requisite characteristics, such as those disclosed in U.S. Pat. No. 4,183,156 to Rudy, could also be used. Further, the bladders can also be fabricated by blow molding or vacuum forming techniques.

As a bladder midsole, bladder 10 defines a forefoot support 14, a heel support 16, and a medial segment 18 interconnecting the two supports. Chambers 12 each define a support portion 13 and a channel portion 15. The support portions 13 are raised to provide a resilient resistance force for an individual's foot. The channel portions 15 are relatively narrow in comparison to support portions 13, and are provided to facilitate the unique manufacturing process described below. Forefoot and heel supports 14, 16 are comprised primarily of support portions 13 so that a cushioned support is provided under the plantar areas receiving the greatest impact pressure during use of the shoe. Channel portions 15, while extending partially into the forefoot and heel supports 14, 16, are concentrated in medial segment 18.

In forefoot support 14, the support portions 13 are arranged parallel to one another in a lateral direction across the sole to provide a suitable flexibility in the forefront sole portion and to apportion the cushioned resistance as desired. Nonetheless. different chamber arrangements could be used.

In the illustrated athletic shoe, forefoot portion 14 includes chambers 12*a–g*. Chambers 12*a–g* are of varying sizes, with the chambers nearer to the front (e.g., chamber 12*a*) defining a larger volume than those closer to medial segment 18 (e.g., chamber 12*g*). As will be described more fully below, all of the chambers 12*a–g* are pressurized to the same level. However, due to the different volumes of the chambers, they will each possess a unique resistance. In other words, the chambers with smaller volumes will provide a firmer support than the chambers with larger volumes, because the movement of a side wall defining a smaller chamber will involve a greater percentage of the volume of air being displaced than the same movement in a larger chamber. Hence, for example, chamber 12*g* will provide a firmer support than chamber 12*a*.

Channel portions 15*a–g* of chambers 12*a–g*, in general, extend rearwardly from support portions 13*a–g* to a seal 20 located transversely across medial segment 18. Channel portions 15 are essential to the unique manufacturing process described below. Preferably, channel portions 15 are provided along the sides of forefoot portion 14, so that the needed cushioned support is not taken from the central portions of the sole where it is most needed. In the illustrated embodiment, channel portions 15 for adjacent chambers 12 are placed on opposite sides of the sole. Of course, other arrangements could be used.

Additionally, in forefoot portion 14, void chambers 22 are defined adjacent the more rearward chambers 12*e–g*. A void chamber 22 is a chamber that has not been pressurized. Void chambers 22 exist because of the need to limit the volume of chambers 12*e–g* to provide a certain firmness in these portions of the bladder. Nevertheless. void spaces are not essential to the present invention and could be eliminated. In a midsole usage (FIG. 4) the resilient foam 11 would fill in the void space and provide ample support to the user's foot.

In a manner similar to forefoot support 14, heel support 16 includes a row of chambers 12*h–j*. In the illustrated bladder, three chambers 12*h–j* are provided. The support portions 13*h–j* of these chambers are arranged parallel to one another in a generally longitudinal direction across the sole to ensure that all three chambers provide cushioned support for all impacts to the user's heel. Nonetheless, as with the forefoot portion, different chamber arrangements could be used. Additionally, each chamber 12*h–j* includes a channel portion 15 which extends from the support portion 13 to seal 20. In the same manner as in forefoot support 14, chambers 12*h–j* provide different resistance forces in the support of the heel. For example, the smaller chamber 12*h* will provide a firmer resistance than the larger chambers 12*i* or 12*j*. The firmer chamber 12*h* would act as a medial post in reducing pronation.

Figure 3:
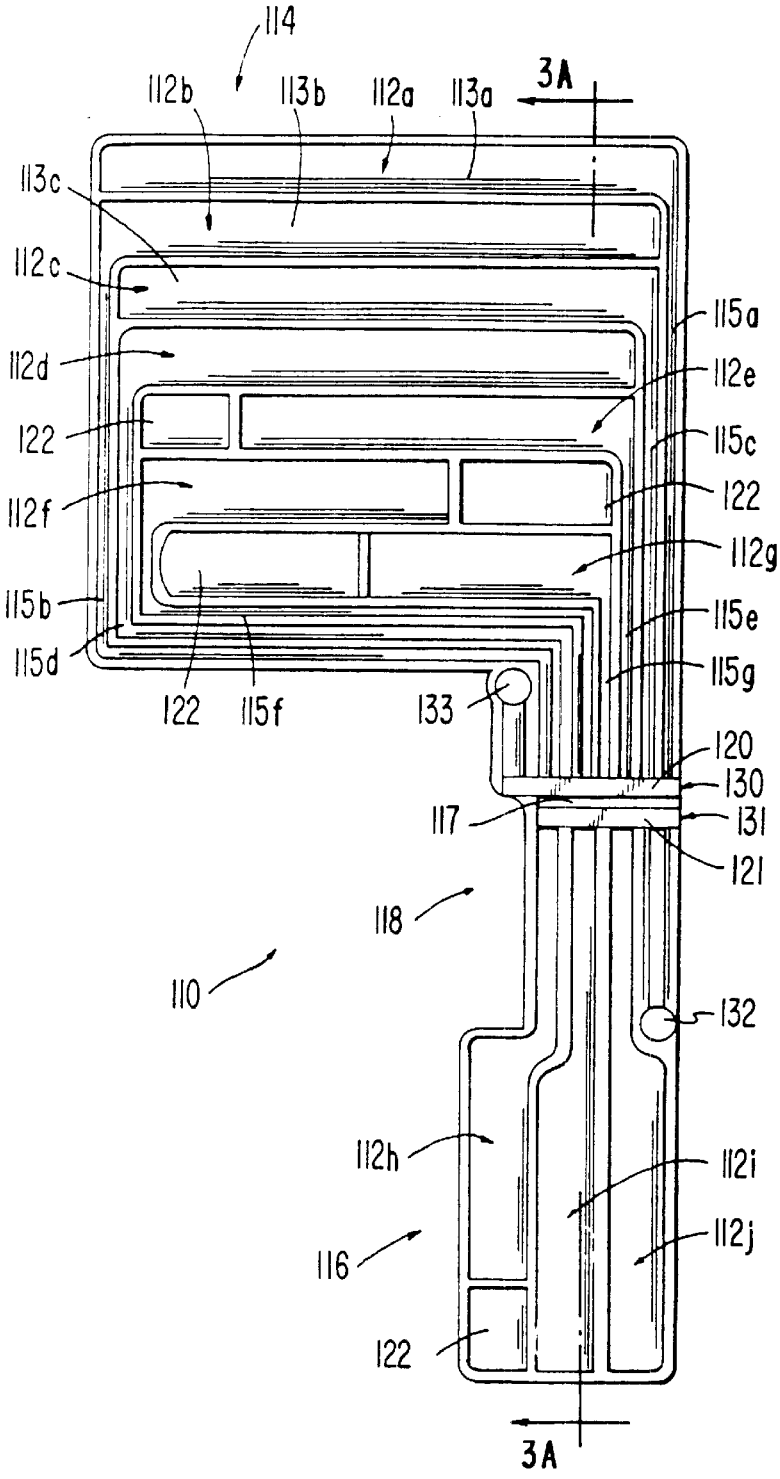
FIG. 3 is a top plan view of a second embodiment of a bladder of the present invention.
Figure 3A:
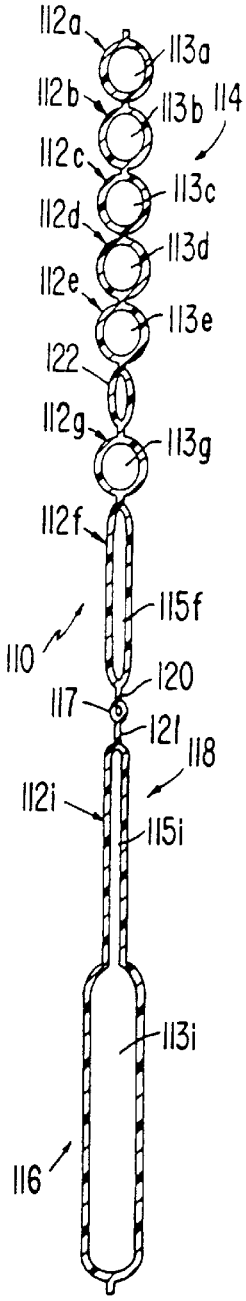
FIG. 3*a* is a cross-sectional view taken along line 3*a*—3*a* in FIG. 3.

In the first embodiment of the invention (FIG. 1), chambers 12*h–j* are pressurized to the same internal pressure as chambers 12*a–g*. One preferred example of internal pressure for athletic footwear is 30 psi. Of course, a wide variety of other pressures could be used. In an alternative embodiment of the invention (FIG. 3), chambers 112*h–j* are pressurized to a different internal pressure than chambers 112*a–g*. As one preferred example, the pressure in the forefoot portion could be set at 35 psi, while the heel portion could be pressurized to 30 psi. The particular pressure in each section though will depend on the intended activity and the size of the chambers, and could vary widely from the given examples.

Figure 2:
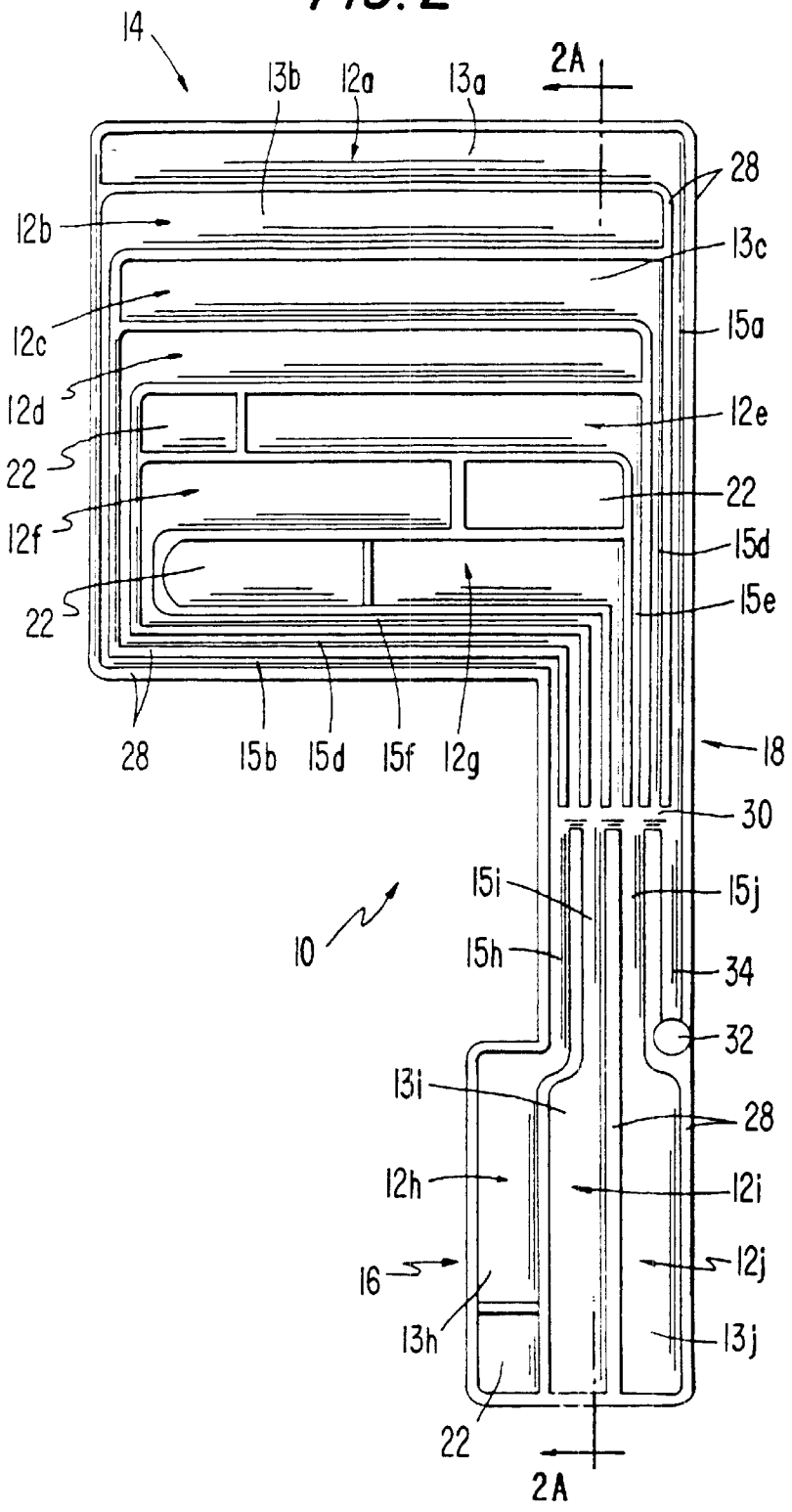
FIG. 2 is a top plan view of a bladder of the present invention at an interim stage of its fabrication.
Figure 2A:
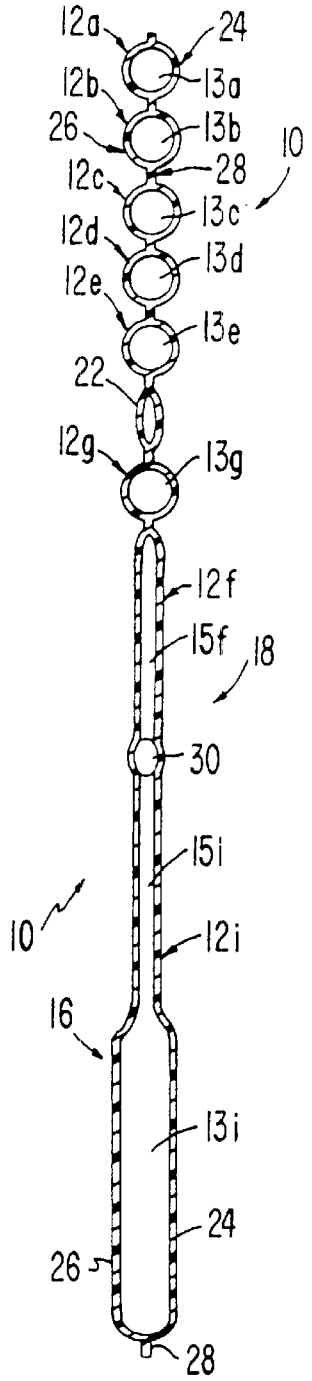
FIG. 2*a* is a cross-sectional view taken along line 2*a*—2*a* in FIG. 2.

In the fabrication of bladder 10, two elastomeric sheets 24, 26 are preferably secured together to define the particular weld pattern illustrated in FIG. 2; that is, that the two opposed sheets 24, 26 are sealed together to define wall segments 28 arranged in a specific pattern (FIG. 2*a*). The welding is preferably performed through the use of radio frequency welding, the process of which is well known. Of course, other methods of sealing the sheets could be used. Alternatively, the bladder could also be made by blow molding or injection molding, the processes of which are also well known.

When the bladder is initially welded (or otherwise formed), a common area 30 is defined at the location where seal 20 is formed (FIG. 2). Common area 30 is fluidly coupled with all of the channel portions 15 of chambers 12*a–j*, so that all of the chambers are in fluid communication with one another.

An injection pocket 32 is provided to supply bladder 10 with a quantity of fluid. Injection pocket 32 is in fluid communication with a pressurizing channel 34, which, in turn, is fluidly coupled to common area 30 (FIGS. 2 and 2*a*). Chambers 12*a–j*, therefore, are pressurized by inserting a needle (not shown) through one of the walls 24, 26 defining injection pocket 32, and injecting a pressurized fluid therein.

The pressurized fluid flows from pocket 32, through channel 34, into common area 30, through channel portions 15*a–j* and into the supporting portions 13*a–j* of all of the chambers 12*a–j*. Once the predetermined quantity of fluid has been inserted into the bladder, or alternatively when the desired pressure has been reached, channel 34 is temporarily clamped.

Walls 24, 26 are welded, or otherwise heat sealed, forming seal 20 (FIG. 1) to completely close common area 30 so that none of the chambers are in fluid communication with any of the other chambers. Although, it may in certain circumstances be desirable to provide interconnecting ports in other portions of the sidewalls of selected chambers. Once sealing weld 20 has been made, the needle is removed and channel 34 remains an uninflated void area. Hence, as can be readily appreciated, this unique independent chamber design can be fabricated by the novel process in an easy, quick, and economical manner.

Figure 1:
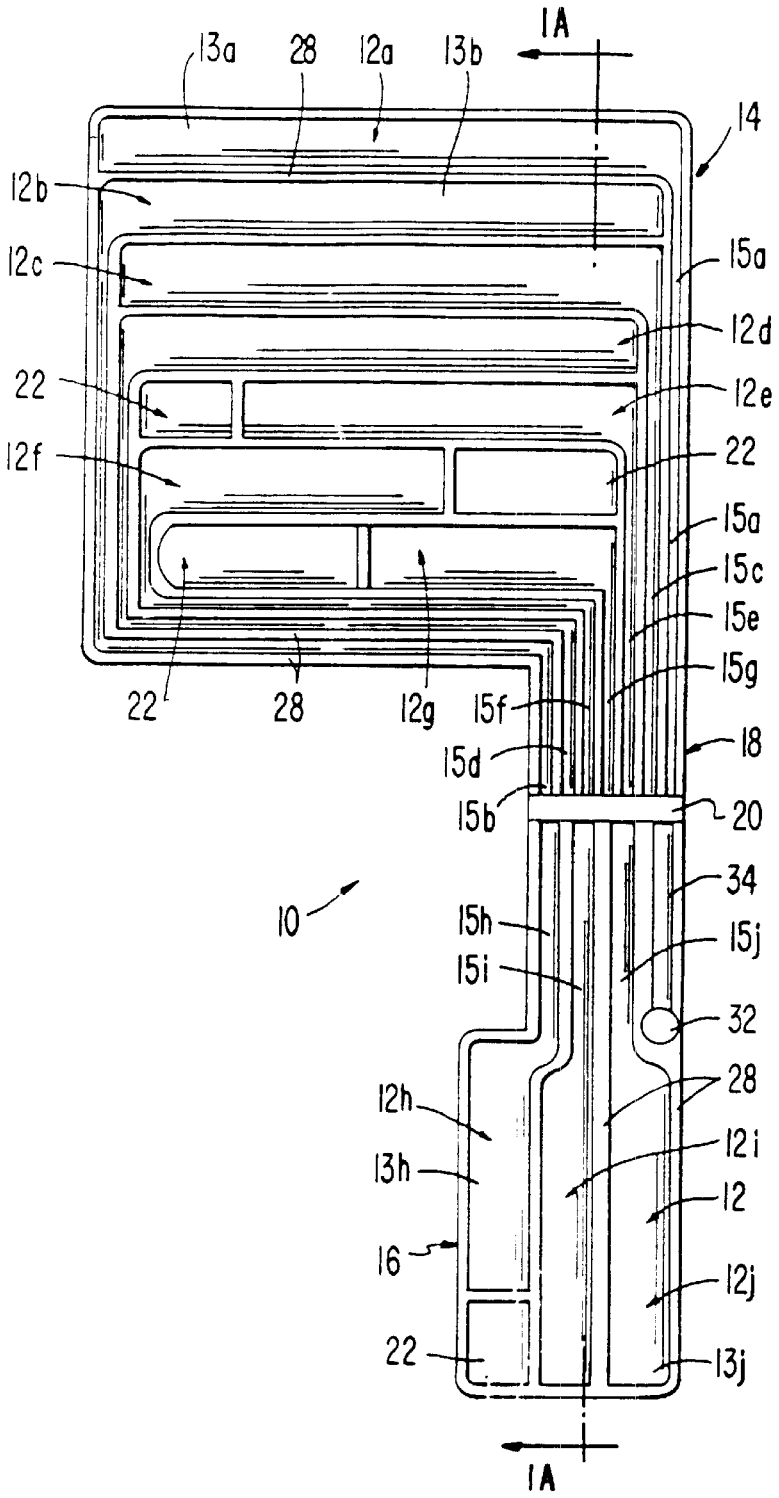
FIG. 1 is a top plan view of a bladder of the present invention.
Figure 1A:
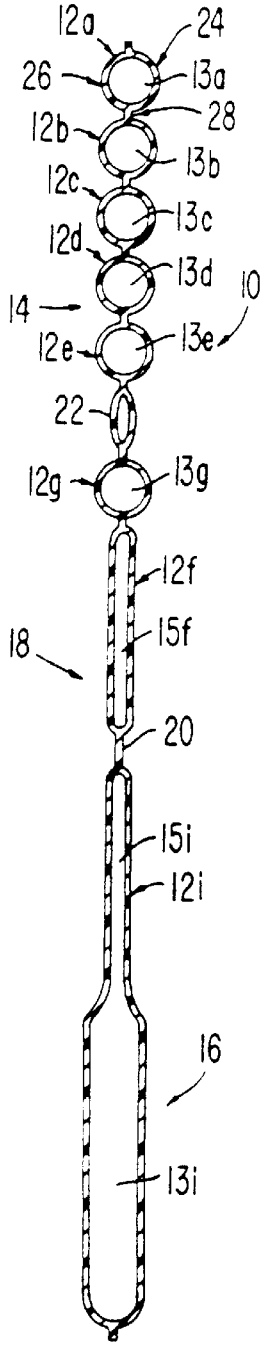
FIG. 1*a* is a cross-sectional view taken along line 1*a*—1*a* in FIG. 1.

The fabrication of a second embodiment (FIG. 3) is similar to that of the first embodiment (FIG. 1). In particular, bladder 110 defines a forefoot support 114, a heel support 116, and a medial segment 118. The forefoot and heel supports 114, 116 each include a plurality of chambers 112. Specifically, forefoot support 114 includes chambers 112*a–g* and heel support 116 includes chambers 112*h–j*. Similarly, each chamber 112 includes a support portion 113 and a channel portion 115. Void chambers 122 are also provided to achieve the desired firmness in chambers 112*e–g* and 112*h*.

In contrast to the first embodiment, forefoot support 114 and heel support 116 are divided by a sealing wall 117 across medial segment 118 prior to the supply of any pressurized fluid. In addition, a common area 130, 131 is defined immediately adjacent each side of the sealing wall 117. Common area 130 is in fluid communication with channels 115*a–g*, and common area 131 is in fluid communication with channels 115*h–j*.

In the fabrication of bladder 110, a needle (not shown) is inserted into each injection pocket 132, 133. In practice, two separate needles are preferably used, although one needle can be successively employed to inject fluid into each support 114, 116 if desired. By providing two separate injection pockets 132, 134 and sealing wall 117, different pressure levels may be supplied into the two separated forefoot and heel supports 114, 116. For instance, forefoot support 114 may be provided with a greater pressure (e.g., 35 psi) than the pressure (e.g., 30 psi) in heel support 116, to meet the specific resistance desired for the intended use of the shoe. Of course, the heel support could be provided with a greater pressure than the forefoot support if desired.

Once all of the chambers have been fully pressurized, the two common areas 130, 131 are then welded (or otherwise heat sealed) to form seals 120, 121. Seals 120, 121 function to close the fluid communication between the chambers so that each chamber is independent and separate from the remaining chambers. Once the seals have been formed the needles can be removed and injection pockets 132, 134 become uninflated void areas.

Figure 5:
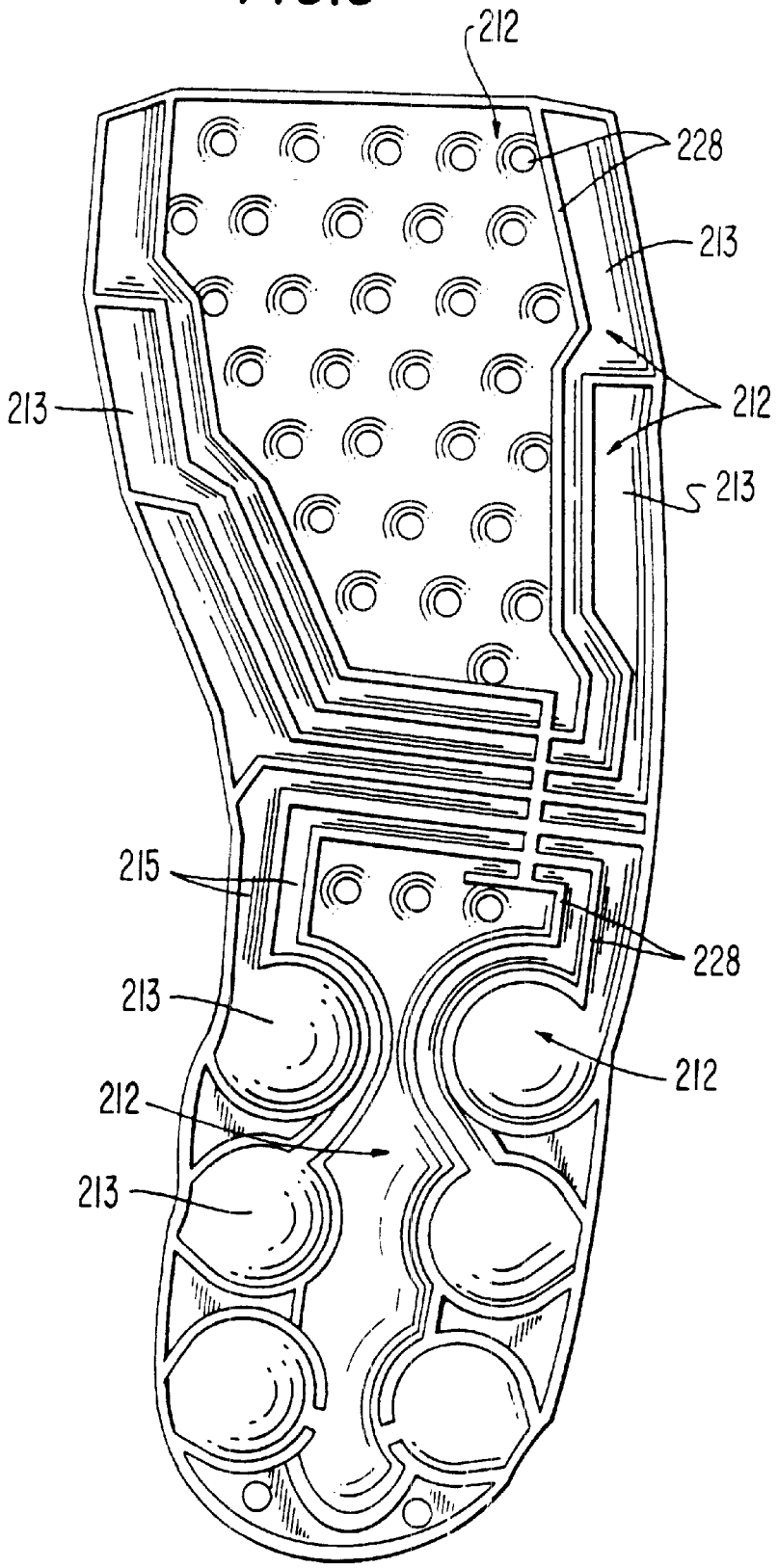
FIG. 5 is a top plan view of a third embodiment of the present invention.
Figure 6:
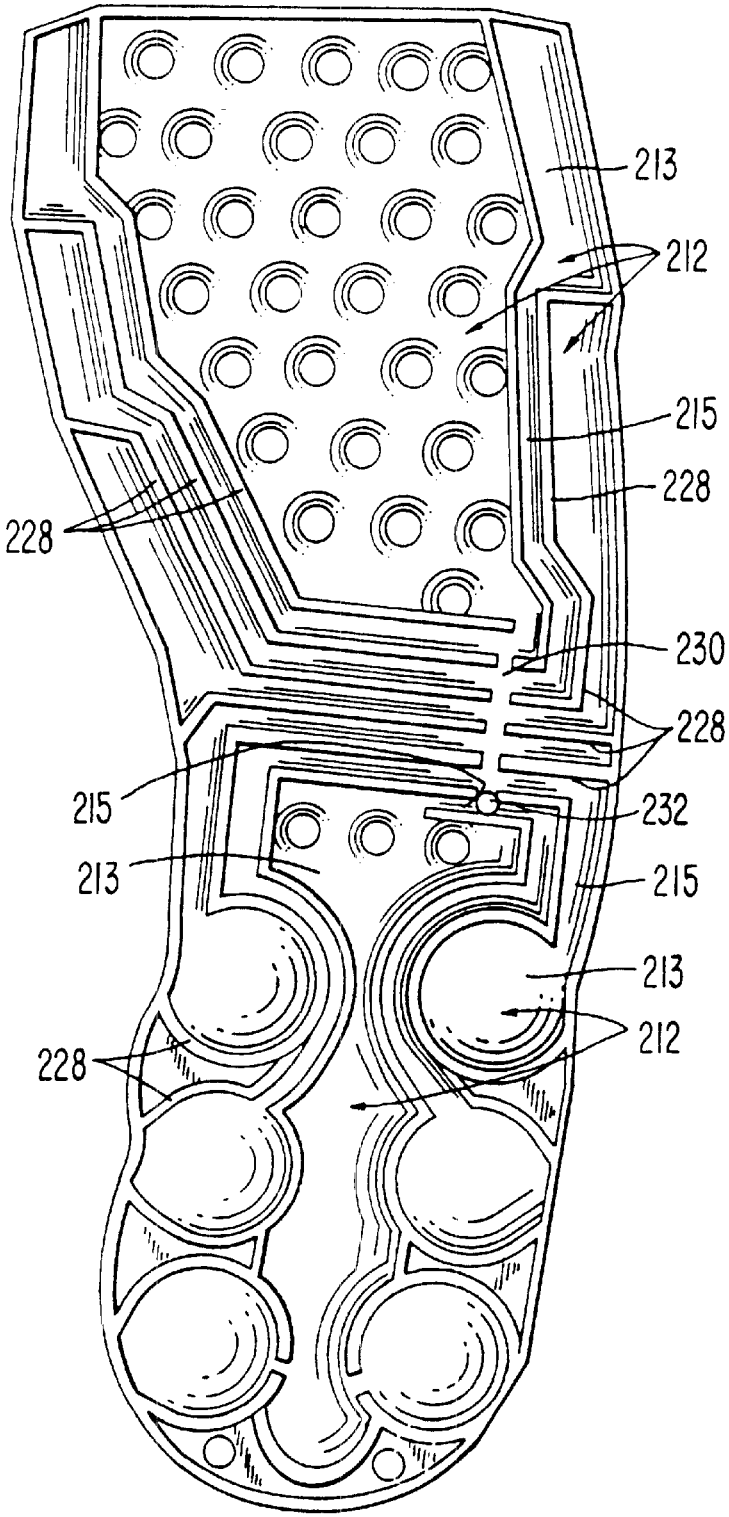
FIG. 6 is a top plan view of the third embodiment at an interim stage of its fabrication.

As can be appreciated, many different chamber configurations are possible. See for instance, FIG. 5 which includes a significantly different weldment pattern 228 defining a plurality a chambers 212. Like the earlier embodiments, the chambers 212 each includes a support portion 213 and a channel portion 215. The channel portions all fluidly interconnect the support portions 213 with a common area 230 (FIG. 6). Once the chambers have been pressurized by inserting a pressurizing needle in pocket 232, the common area is sealed so that each chamber is separated from the other chamber (FIG. 5).

Figure 7:
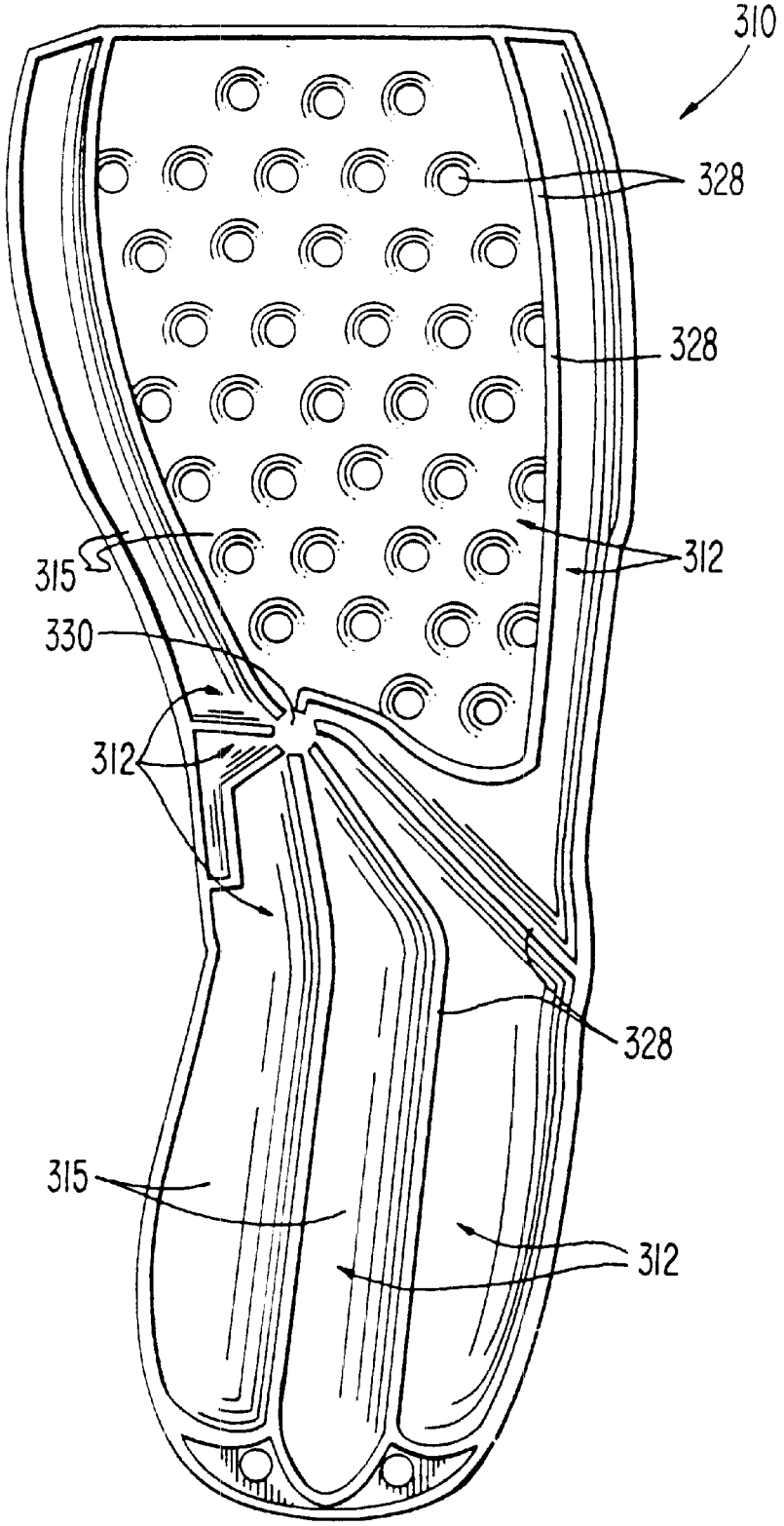
FIG. 7 is a top plan view of a fourth embodiment of the present invention at an interim stage in its fabrication.

In another embodiment (FIG. 7), the bladder 310 is designed such that the channel portions are eliminated. More specifically, bladder 310 is formed by a weldment pattern 328 defining a plurality of chambers 312 comprised solely of support portions 315. The chambers are initially all fluidly interconnected via common area 330. Once the bladder has been fully pressurized, the common area 330 is sealed off to eliminate the fluid interconnection between the chambers (not shown).

Figure 8:
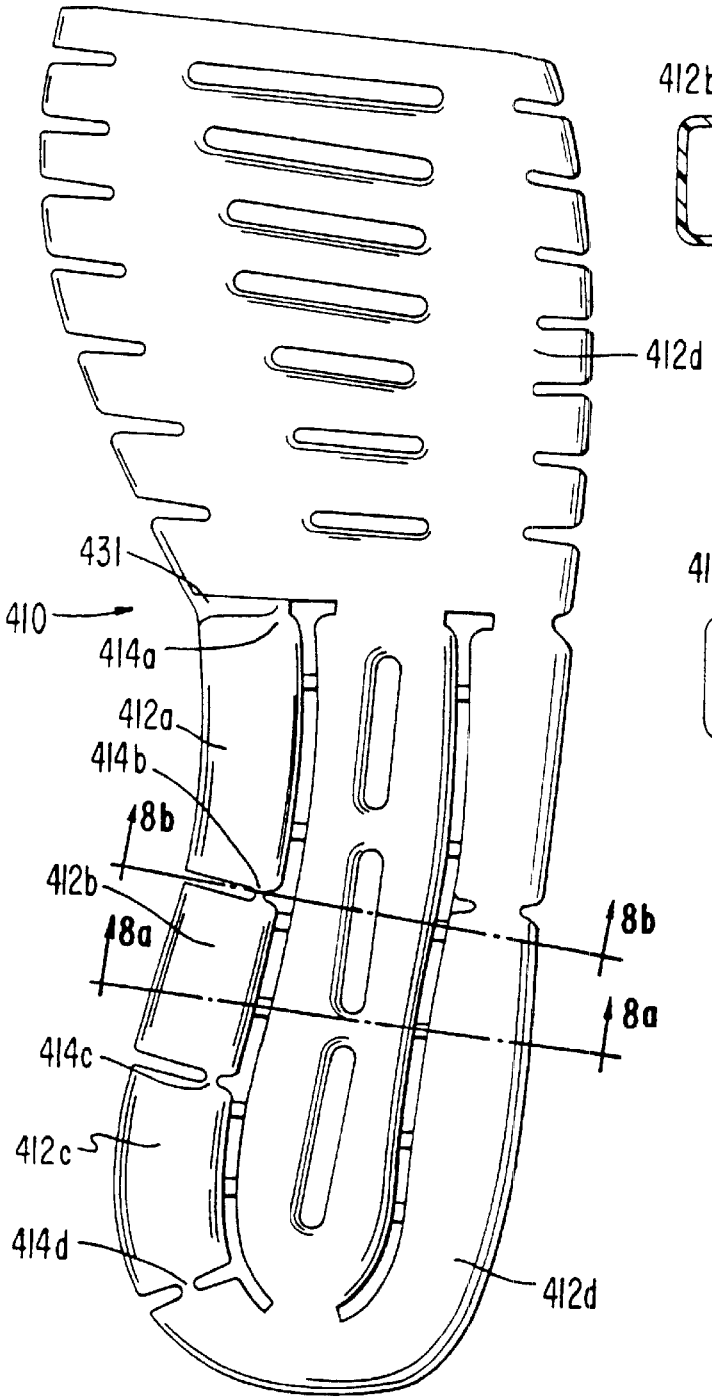
FIG. 8 is a top plan view of a fifth embodiment of the present invention at an interim stage of its fabrication.
Figure 8A:
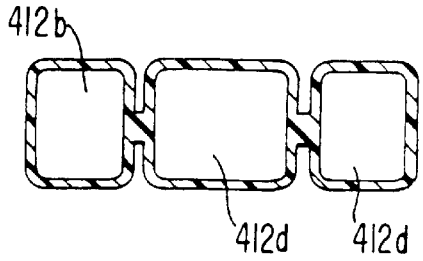
FIG. 8*a* is a cross-sectional view taken along line 8*a*—8*a* in FIG. 8.
Figure 8B:
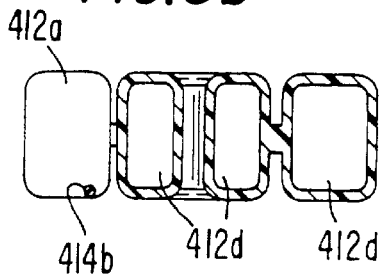
FIG. 8*b* is a cross-sectional view taken along line 8*b*—8*b* in FIG. 8.

FIG. 8 illustrates a bladder 410 which has been blow molded. In this embodiment, a plurality of chambers 412*a–d* are arranged into a unique pattern. The chambers are fluidly interconnected by ports 414*b–d*. Of course other patterns of chambers and ports could be used. In any event, this embodiment does not include a common area to which each chamber is joined. Rather, the chambers 412 are sequentially interconnected.

Once the chambers have been formed, a needle is inserted into the side of pocket 431 to pressurize the chambers. As can be readily appreciated, the chambers 412 are pressurized by the fluid passing sequentially through chambers 412*a–d* and ports 414*a–d*. When the fluid injection is complete, the ports 414*a–d* are sealed to separate the chambers from one another (not shown). The sealing process is preferably formed in a single step by a specially configured die.

The above description is that of preferred embodiments of the invention. Various alterations and changes may be made without departing from the spirit and broader aspects of the invention as set forth in the appended claims, which are to be interpreted in accordance with the principles of patent law including the doctrine of equivalents.

What is claimed is:

1. A method of making a bladder usable in a sole of a shoe to support an individual's plantar area, said method comprising:

forming a body composed of elastomeric material to include a plurality of chambers and a common area, such that each of said chambers is in fluid communication with said common area;

supplying fluid into said body so that each of said chambers is pressurized to the same internal pressure; and sealing said common area such that said chambers are closed to prevent fluid communication between said chambers via said common area.

2. A method as defined in claim 1, in which said sealing of said common area is subsequent to said supplying of fluid to said body.

3. A method as defined in claim 1, in which said forming of said body includes defining chambers at selected locations to be of different sizes and hold different volumes of air.

4. A method as defined in claim 1, in which said forming of said body includes defining a forefoot support, a heel support, and a medial segment interconnecting said forefoot and heel supports, and defining said common area in said medial segment.

5. A method of making a bladder usable in a sole of a shoe to support an individual's plantar area, said method comprising:

forming a body composed of elastomeric material to define a plurality of chambers and a common area, such that each of said chambers is in fluid communication with said common area, said forming of the body including the steps of defining a forefoot support, a heel support, and a medial segment interconnecting said forefoot and heel supports, and defining said common area in said medial segment, and defining said chambers in said forefoot and heel support portions to each include a support portion to provide a resilient resistance support to the plantar area and a channel portion to fluidly connect said support portion and said common area prior to sealing said common area;

supplying fluid into said body so that each of said chambers is pressurized to the same internal pressure; and sealing said common area such that said chambers area closed to prevent fluid communication between said chambers via said common area.

6. A method of making a bladder usable in a sole of a shoe to support an individual's plantar area, said method comprising:

forming a body composed of elastomeric material to include a plurality of chambers and a common area, such that each of said chambers is in fluid communication with said common area, said forming of said body including the step of defining each said chamber to include a support portion to provide a resilient resistance support to the plantar area and a channel portion to fluidly connect said support portion and said common area prior to sealing said common area;

supplying fluid into said body so that each of said chambers is pressurized to the same internal pressure; and sealing said common area such that said chambers area closed to prevent fluid communication between said chambers via said common area.

7. A method as defined in claim 6, in which said forming of said body further includes defining said channel portions to be relatively narrow with respect to said support portions.

8. A method of making a bladder usable in a sole of a shoe to support an individual's plantar area, said method comprising:

forming a body composed of elastomeric material to include a plurality of chambers and a common area, such that each of said chambers is in fluid communication with said common area, said forming of said body including the steps of forming a first set of chambers and a first common area such that each of said chambers in said first set is in fluid communication with said first common area, forming a second set of chambers and a second common area such that each of said chambers in said second set is in fluid communication with said second common area, and forming a dividing wall positioned so that said neither of said first set of chambers nor first common area is in fluid communication with either of said second set of chambers and said second common area;

supplying fluid into said body so that each of said chambers is pressurized to the same internal pressure; and sealing said common area such that said chambers area closed to prevent fluid communication between said chambers via said common area.

9. A method as defined in claim 8, in which said supplying of fluid into said body includes supplying a quantity of fluid into each of said sets of chambers so that said first set of chambers are pressurized at a different internal pressure than said second set of chambers.

10. A method of fabricating a cushioning bladder comprising:

forming a resilient casing having a plurality of discrete sections separated by a partition preventing fluid interconnection, each of said sections defining a plurality of chambers fluidly interconnected by at least one port;

supplying fluid into each section of said casing so that one section is pressurized to a first pressure and the other section is pressurized to a second pressure;

sealing said ports to prevent passage of the fluid therethrough.

11. A method in accordance with claim 10 wherein said first pressure is different from said second pressure.

12. A method of fabricating a cushioning bladder comprising:

forming a resilient casing having at least a portion thereof defining a plurality of fluidly interconnected chambers;

supplying fluid into said chambers to pressurize said chambers above ambient pressure;

sealing said bladder to prevent fluid interconnection between said chambers after said pressurizing of said chambers.

13. A method in accordance with claim 12 which said casing includes a plurality of discrete portions divided by partitions preventing fluid interconnection, wherein each said portion defines a plurality of chambers.

14. A method in accordance with claim 13 wherein said chambers of one portion are pressurized to a different pressure than said chambers of the other portion.

15. A method of making a bladder usable in a sole of a shoe for supporting an individual's plantar area, said method comprising:

forming a thin, elastomeric member defining a forefoot segment, a heel segment, and a medial segment interconnecting said forefoot and heel segments, and including a plurality of chambers and a common area in at least one of said segments, said chambers being arranged such that each of said chambers is in fluid communication with said common area but otherwise is completely closed;

supplying fluid into said chambers of said elastomeric member at only one location so that all of said chambers are pressurized to the same internal pressure; and sealing said common area after said supplying of said fluid so that fluid communication between any of said chambers is precluded.

16. A method as defined in claim 15, in which said forming of said elastomeric member includes forming said chambers with different dimensions so that each chamber defines a different volume than at least one other chamber.

17. A method of making a bladder usable in a sole of a shoe for supporting an individual's plantar area, said method comprising:

forming a thick elastomeric member defining a forefoot segment, a heel segment, and a medial segment interconnecting said forefoot and heel segments, and including a plurality of chambers and two sets of chambers and two common areas, such that one set of chambers is in fluid communication with one common area and the other set of chambers is in fluid communication with the other common area, but wherein no fluid communication exists between the two sets of chambers;

supplying fluid into said chambers of said elastomeric member at only one location so that all of said chambers are pressurized to the same internal pressure; and sealing said common area after said supplying of said fluid so that fluid communication between any of said chambers is precluded.

18. A method as defined in claim 17, in which said supplying of fluid further includes supplying fluid into said chambers at two selected locations so that the chambers of each set are all pressurized at the same internal pressure and the chambers of the different sets are pressurized at different internal pressures.

19. A method of making a shoe sole comprising the steps of:

forming a bladder having opposing surfaces from elastomeric material, said bladder formed to include two chambers opened at one end to a common area said chambers isolated from each other except at said common area;

supplying fluid into said bladder, said fluid flowing through said common area so that each chamber is pressurized;

joining said surfaces to each other at the common area after the chambers are pressurized and thereby isolating said chambers out of fluid communication from each other; and inserting said bladder into a shoe sole assembly.

20. The method recited in claim 19, wherein, the step of forming one of the chambers to have a different volume from the other of the chambers.

21. The method recited in claim 20 comprising the further step of covering at least a portion of said bladder with an elastomeric foam material.

22. The method recited in claim 19, wherein the step of supplying fluid comprises pressurizing to a level above ambient pressure.

23. The method recited in claim 19, wherein the step of joining the surfaces comprises welding.

* * * * *